United States Patent [19]

Prouty

[11] 4,453,201

[45] Jun. 5, 1984

[54] ELECTRICALLY ILLUMINATED CROSS

[76] Inventor: Lee W. Prouty, 33 Chapel La., Danville, Ill. 61832

[21] Appl. No.: 389,396

[22] Filed: Jun. 17, 1982

[51] Int. Cl.[3] ..... F21P 1/02

[52] U.S. Cl. ..... 362/121; 362/252; 362/307; 362/310; 362/311; 362/346; 362/347; 362/367; 362/807

[58] Field of Search ..... 362/121, 252, 307, 310, 362/311, 346, 347, 367, 807

[56] References Cited

U.S. PATENT DOCUMENTS 1,391,945 9/1921 Flagge ..... 362/121

1,524,835 2/1925 Mattern et al. ..... 362/121

*Primary Examiner*—Stephen J. Lechert, Jr.

[57] ABSTRACT

Illuminated cross having a frame consisting of pairs of vertical and horizontal plates intersecting at knotches therein so that the front and back surfaces thereof are in the same respective vertical planes and that the intersection forms a t-shaped cross; having the front and back surfaces of the resultant cross covered by sheets of translucent material; and having means for illuminating the same including electric bulbs located at the ends of the cross segments, semi-circular notches formed inthe frame plates intermediate the intersections thereof, and convex-shaped reflectors located on the outside of the frame plates adjacent the semi-circular notches.

2 Claims, 6 Drawing Figures

ELECTRICALLY ILLUMINATED CROSS

BACKGROUND OF THE INVENTION

This invention relates to electrically illuminated crosses designed to be anchored to the ground and elevated for glowing display on hillsides, church lawns and religiously dedicated property and designed for construction in varied heights.

A wide variety of illuminated crosses have been proposed in the prior patent art. Such previously available cross designs, however, have not proven to be completely satisfactory in actual use, when attempted to be utilized as relatively large outdoor displays, due to one or more drawbacks including a lack of suitable structural strength, a failure of emanating satisfactory uniformity of light throughout the cross, being too complicated in basic design entailing undesirably high initial investment costs and maintenance and operating expenditures, and/or not being adapted to be erected and maintained by persons of ordinary skills. Illustrative of such prior art crosses are those shown in U.S. Pat. Nos. 676,853; 738,601; 1,391,945; 1,524,835; 2,036,616; and 2,427,655.

Applicant himself constructed and utilized previously a prior art illuminated cross that consisted of pairs of vertical and horizontal plates intersecting at notches therein so that the plates formed a t-shaped cross, having front and back surfaces of translucent material, and having semi-circular notches formed in the frame plates between the intersections of the plates, with the entire cross being lit by electric lamps located at the ends of the cross segments. Such a cross satisfied many of the drawbacks of other previous illuminated crosses, but still suffered certain disadvantages including a concentration of light at the ends of the cross and a need to utilize higher rated bulbs to effect illumination, with their concomitant operating expense.

Accordingly, a search has continued in the art for an improved more satisfactory illuminated cross design.

OBJECTS OF THE PRESENT INVENTION

Accordingly, it is the primary object of the present invention to provide an improved illuminated cross.

Another object of the present invention is to provide an improved illuminated cross which is designed to withstand very high winds and have an illumination feature that has a viewing range of great distances.

An addditional object of the present invention is to provide an improved illuminated cross having a frame composed of four sections, each section being double notched and having a semi-circular notch on each edge and amid double notched area, whereby when said sections intersect, they interlock cross structure and form eight semi-circular notches for light infiltration into center section of cross when structure is illuminated.

A further object of the present invention is to provide an improved illuminated cross having a concrete base to prevent structural deterioration with steel supports and guy wires to hold the cross structure in place.

Still another object of the present invention is to provide an improved illuminated cross having flood bulbs, namely one at each end of the cross arm and stem, in such correlation with convex reflecting means positioned adjacent the semi-circular notches that the lights are magnified widely and the resultant illumination is essentially uniform across the entire cross structure.

Yet an additional object of the present invention is to provide an improved illuminated cross that has front and rear frosted transparent material, preferably frosted transparent acrylite, for strength and flexibility in strong winds and damaging hail storms and the light rays follow up, down and across said transparent (actually translucent) material emanating a radiant beacon of light.

Another object of the present invention is to provide an improved illuminated cross having caps at the end of each of the cross arms and stem top.

A further object of the present invention is to provide an improved illuminated cross having access panels for easy entry for insertion and removal of bulbs with vents affixed thereto with louvers facing downward in order to eliminate bulb heat and direct away atmospheric conditions.

A particular object of the present invention is to provide an improved illuminated cross having excellent illumination uniformity characteristics and yet which still is simple in construction so may be erected and maintained by persons of simple skills and is more ecomical to build, maintain, and, due to an ability to utilize smaller rated bulbs, operate.

BRIEF DESCRIPTION OF ACCOMPANYING DRAWINGS

The invention will be described in more detail hereinbelow with particular reference being made to the accompanying drawings of which:

DESCRIPTION OF SPECIFIC EMBODIMENTS

Figure 1:
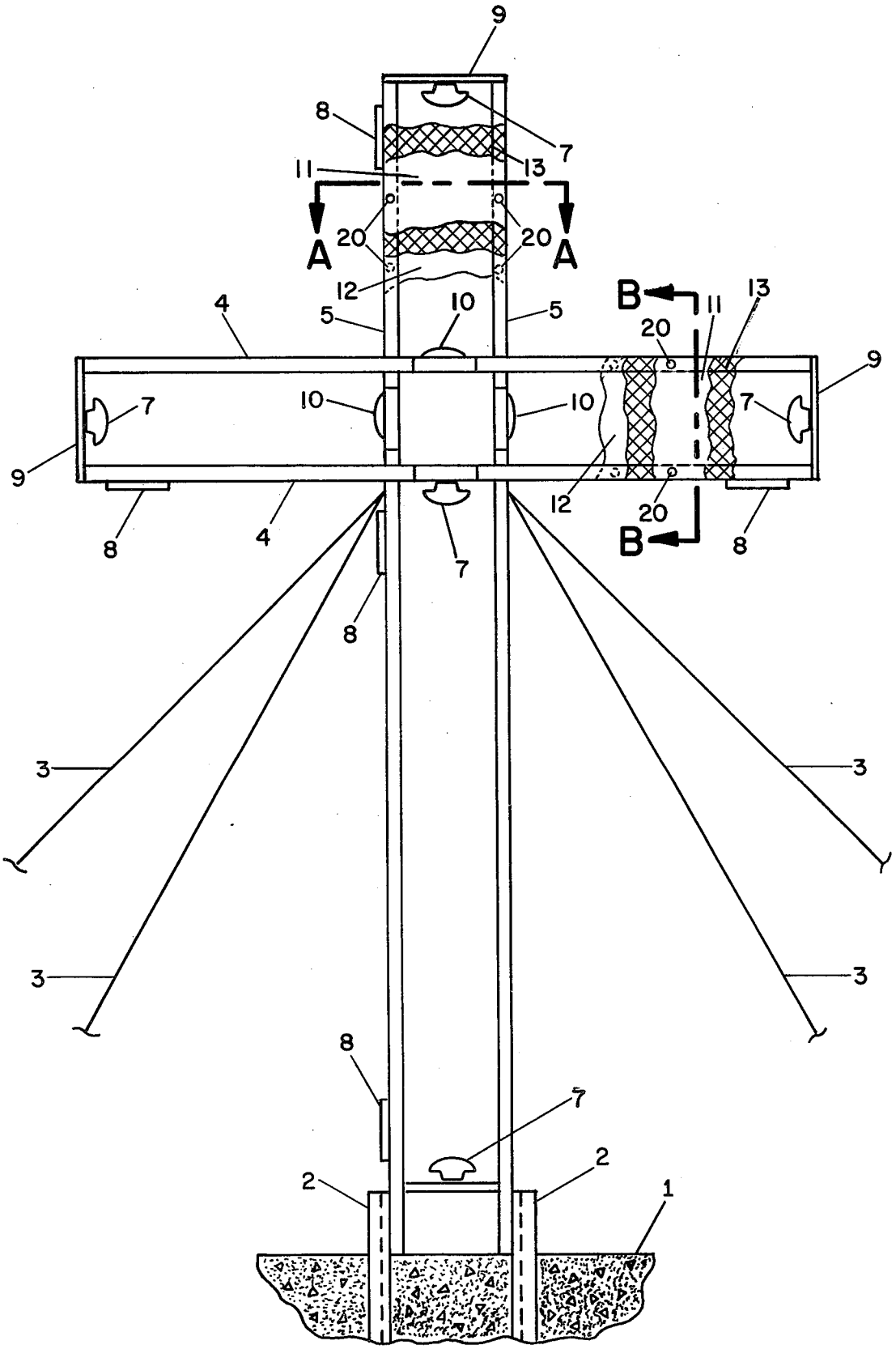
FIG. 1 is a front elevation view, partially broken away and partially in phantom, showing an iluminated cross of the present invention.
Figure 2:
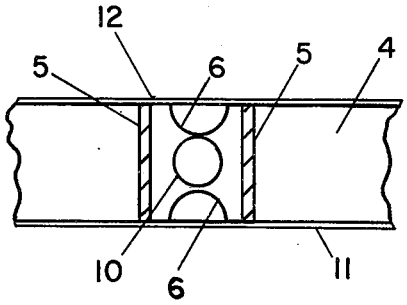
FIG. 2 is a sectional view of FIG. 1 taken at line A—A.
Figure 3:
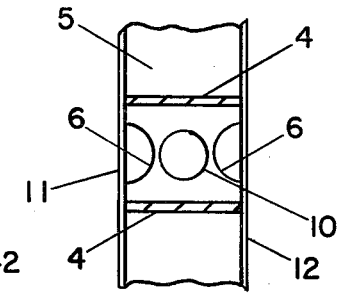
FIG. 3 is a sectional view of FIG. 1 taken at line B—B.
Figure 4:
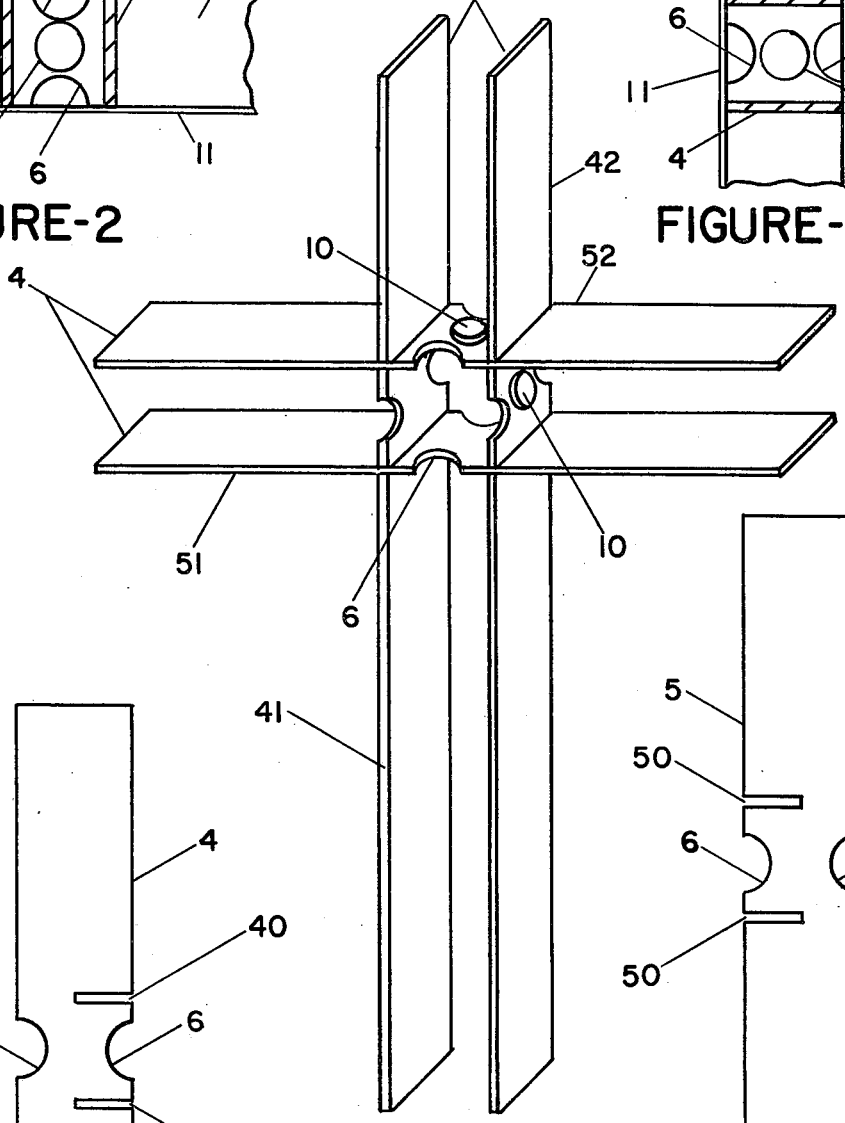
FIG. 4 is an isometric view showing the skeletal frame of the cross of the present invention.
Figure 5:
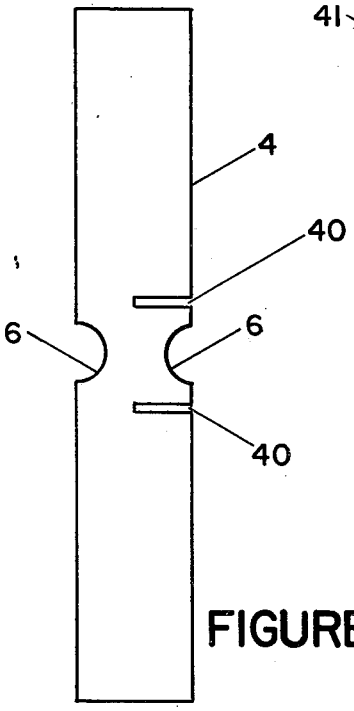
FIG. 5 is a detail side view showing one cross arm plate.
Figure 6:
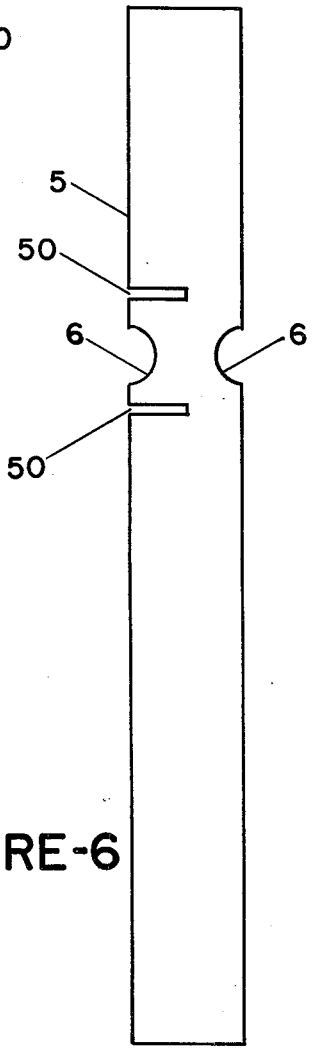
FIG. 6 is a detail side view showing one cross stem plate.

With reference to FIG. 1 the lower portion of the stem of the cross shown is pedestaled on a concrete base 1 and anchored with steel supports 2 bolted to the lower portion of the cross frame and laid in said concrete base 1. The cross frame, braced by guy wires 3, is constructed in four plate sections. Two spaced, parallel horizontal cross arm plate members 4, which are double notched, as shown in FIG. 5, intersect two spaced, parallel vertical stem plate members 5, which are also double notched, as shown in FIG. 6, each of said plate members having a semi-circular notch 6 on each edge and amid the double notched area, whereby when said pairs of parallel plates intersect and are fitted together with the respective notch-slots 40 and 50 in horizontal plates 4 and vertical plates 5 meeting in cooperating engagement in male-female fashion, such engagement forms a t-shaped frame in which the front edges 41, 51 and back edges 42, 52 of the respective plates are in common vertical planes, i.e., the front faces and rear faces of the frame members are flush with each other, and an interlocked frame is produced, in which eight semi-circular notches 6 are located intermediate the intersection of plates 4 and 5 to allow light to infiltrate into the cross center when illuminated, as described below.

For illumination of the cross electric flood bulbs 7 are positioned at each end of horizontal plate pair 4, at the top and bottom of vertical plate pair 5, and adjacent and below the intersection of pairs 4,5. The illumination means provided for the cross further includes convex reflector means 10 located on the outside of each of horizontal and vertical plate members 4,5 adjacent and intermediate semi-circular notches 6.

The utilization of such reflector means 10 advantageously improves the uniformity of the illumination throughout the cross and further advantageously allows the use of smaller rated flood bulbs 7 with an attendant reduction in the expense of operating the cross.

Access panels 8 are located adjacent the positions of bulbs 7 for easy installation and replacement of such bulbs.

The frame of the cross is enclosed by caps 9 affixed to each exposed end of the plate member pairs 4,5, and by sheets 11,12 of frosted transparent (translucent) material, preferably acrylic plastic, on the face and back of the t-shaped frame, respectively, with the such sheets, although being shown in broken away condition in FIG. 1 for convenience, actually completely covering the frame's front and rear surfaces. Attachment of sheets 11, 12 suitably may be through any conventional mounting means, e.g., screw means 20. In certain preferred embodiments, a sheet of wire mesh 13 is positioned underlying a sheet 11, 12 to reduce any wind-induced flexing of such sheets and thereby increase the strength of the cross, and to act as a further reflecting means for light traveling within the cross.

What is claimed is:

1. An illuminated cross comprising:

(1) a pair of spaced, adjacent vertical plate members;

(2) a pair of spaced, adjacent horizontal plate members;

said pairs of vertical and horizontal plate members intersecting and mating at horizontal and vertical slots formed therein, respectively, and extending partially therethrough so that with the mating of said slots a t-shaped cross is formed having the front and back surfaces thereof in common vertical planes, (3) end plate elements covering the spaces between the tops of said vertical plate members and the ends of said horizontal plate members;

(4) support means at the base of said t-shaped cross frame;

(5) sheets of translucent material covering each the front and back of said t-shaped cross; and (6) means for illuminating the interior of said t-shaped cross including electric bulbs positioned adjacent the ends of of said pairs of vertical and horizontal plate members and adjacent and below the intersection thereof, including semi-circular notches formed on each the front and back edges of each said vertical and horizontal plate member intermediate the intersention of said plate members, and including convex reflector means positioned on the outside of said plate members between said semi-circular notches.

2. The illuminated cross according to claim 1 wherein a sheet of wire mesh underlays at least one of said sheets of translucent material on the face of said t-shaped cross frame.

* * * * *